United States Patent [19]

Tomimatsu

[11] Patent Number: 4,951,477

[45] Date of Patent: Aug. 28, 1990

[54] AIR CONDITIONING SYSTEM

[75] Inventor: Shigenao Tomimatsu, Takasaki, Japan

[73] Assignee: Sanden Corportion, Japan

[21] Appl. No.: 445,100

[22] Filed: Dec. 7, 1989

Related U.S. Application Data

[63] Continuation of Ser. No. 219,225, Jul. 19, 1988, abandoned.

[30] Foreign Application Priority Data

Jul. 15, 1987 [JP] Japan ..... 62-108660[U]
Jul. 15, 1987 [JP] Japan ..... 62-108662[U]

[51] Int. Cl.[5] ..... B05B 3/16

[52] U.S. Cl. ..... 62/217; 62/239; 62/323.3; 62/408

[58] Field of Search ..... 62/429, 323.3, 217, 62/408; 165/103

[56] References Cited

U.S. PATENT DOCUMENTS

| | | | |
|---|---|---|---|
| 2,257,164 | 9/1941 | Euwer | 62/429 X |
| 2,549,547 | 4/1951 | Trask | 62/429 X |
| 2,674,178 | 4/1954 | Wallin et al. | 165/103 X |
| 3,415,072 | 12/1968 | White | 62/429 X |
| 3,678,697 | 7/1972 | Anderson | 62/429 X |
| 3,783,634 | 1/1974 | Heidorn | 62/217 |
| 4,852,391 | 8/1989 | Ruch et al. | 73/40.5 R |
| 4,857,755 | 8/1989 | Comstock | 307/47 |

*Primary Examiner*—William E. Wayner
*Attorney, Agent, or Firm*—Banner, Birch, McKie and Beckett

[57] ABSTRACT

An air conditioning system is disclosed which includes a compressor, a condenser, an evaporator, a first fan for the condenser, a second fan for the evaporator, and an oil hydraulic motor for the driving compressor. A rotation transmitting mechanism couples the first and second fans with the oil hydraulic motor to transmit rotational force from the oil hydraulic motor to the first and second fans. A hand operating mechanism is connected through a coupling to an air mix damper which is disposed between the second fan and the evaporator. The hand operating mechanism is operated to control the proportion of the air which passes through the evaporator to the air which does not pass through the evaporator.

8 Claims, 8 Drawing Sheets

AIR CONDITIONING SYSTEM

This application is a continuation of application Ser. No. 219,225, filed July 15, 1988, abandoned.

This application is related by subject matter to commonly assigned application Ser. Nos. 219,226 and 220,511 filed concurrently herewith.

TECHNICAL FIELD

The present invention generally relates to an air conditioning system, and more particularly, to an air conditioning system which does not require the use of electricity.

BACKGROUND OF THE INVENTION

FIG. 1 shows a schematic side view of a working vehicle 1 adapted for work on overhead power lines and which includes an air conditioning system 10 for a worker A.

Air conditioning system 10, illustrated in FIG. 2, includes an oil hydraulic motor 20, a generator 30 and a compressor 40, each of which is disposed in the lower portion of a case 101. The rotational force of oil hydraulic motor 20 is transmitted to generator 30 and compressor 40 through a belt 50. An upper passageway 60 is formed at the upper portion of case 101 and includes an evaporator 70 and a fan 80. A condenser 90 and a fan 100 for the condenser are also disposed in case 101. When the air conditioning system is turned on, generator 30 and compressor 40 are driven in response to the rotational force of oil hydraulic motor 20. Generator 30 generates and transmits electricity to fans 80 and 100, whereby fans 80 and 100 are driven. Refrigerant in a refrigerant circuit is circulated through evaporator 70 and condenser 90 by the operation of compressor 40. Accordingly, air which flows into upper passageway 60 is cooled by evaporator 70 and sent to the interior of a suit a of worker A through a flexible hose 110. Suit a is made of rubber to insulate the worker and protect him from electric shocks. The temperature of the cooled air is controlled by a thermo-amplifier 4 which is coupled to a temperature sensor 2 (disposed on the outflow side of evaporator 70), an electromagnetic clutch 3 which is mounted on compressor 40, and generator 30. This arrangement is schematically illustrated in FIG. 3.

In the above-described air conditioning system, electromotive force produced by generator 30 is used to drive fans 80 and 100, electromagnetic clutch 3 and thermo-amplifier 4. The use of electrical devices by a worker working in close proximity to power lines is dangerous and increases the chances that the worker will accidentally be injured or killed during the performance of his job. In addition, since fans 80 and 100 are driven by an electrical motor, the system is expensive to operate.

Furthermore, compressor 40 must be periodically stopped to remove frost on evaporator 70 in order to maintain the refrigerating capacity of the air conditioning system. This requires that the air conditioning operation be stopped during removal of the frost.

SUMMARY OF THE INVENTION

Accordingly, it is an object of the present invention to provide an air conditioning system which may be operated safely by a worker working in close proximity to sources of electricity.

It is another object of the present invention to provide an air conditioning system which can drive and control the respective fans for an evaporator and a condenser without using electric power.

It is still another object of the present invention to provide an air conditioning system in which frost does not form on the evaporator.

An air conditioning system according to the present invention includes a compressor, a condenser, an evaporator, a first fan for the condenser, a second fan for the evaporator, and an oil hydraulic motor for driving the compressor. A rotation transmitting mechanism couples the first and second fans with the oil hydraulic motor to transmit rotational force from the oil hydraulic motor to the first and second fans. A temperature control mechanism controls the temperature of air output from the air conditioning system. The temperature control mechanism includes a damper disposed between the second fan and the evaporator for selectively regulating the volume of air which passes through the evaporator.

Additionally, an air conditioning system according to another embodiment of the present invention includes a compressor, a condenser, an evaporator, a first fan for the condenser, a second fan for the evaporator, and an oil hydraulic motor for driving the compressor. A rotation transmitting mechanism couples the first and second fans with the oil hydraulic motor to transmit rotational force from the oil hydraulic motor to the first and second fans. A pressure control device is disposed between the evaporator and the compressor to control the evaporating pressure of refrigerant in the evaporator to be greater than or equal to a predetermined pressure.

BRIEF DESCRIPTION OF THE DRAWINGS

A more complete appreciation of the present invention and many of the attendant advantages thereof will be readily obtained as the invention becomes better understood by reference to the following detailed description when considered in connection with the accompanying drawings wherein.

DETAILED DESCRIPTION OF THE PREFERRED EMBODIMENT

Figure 1:
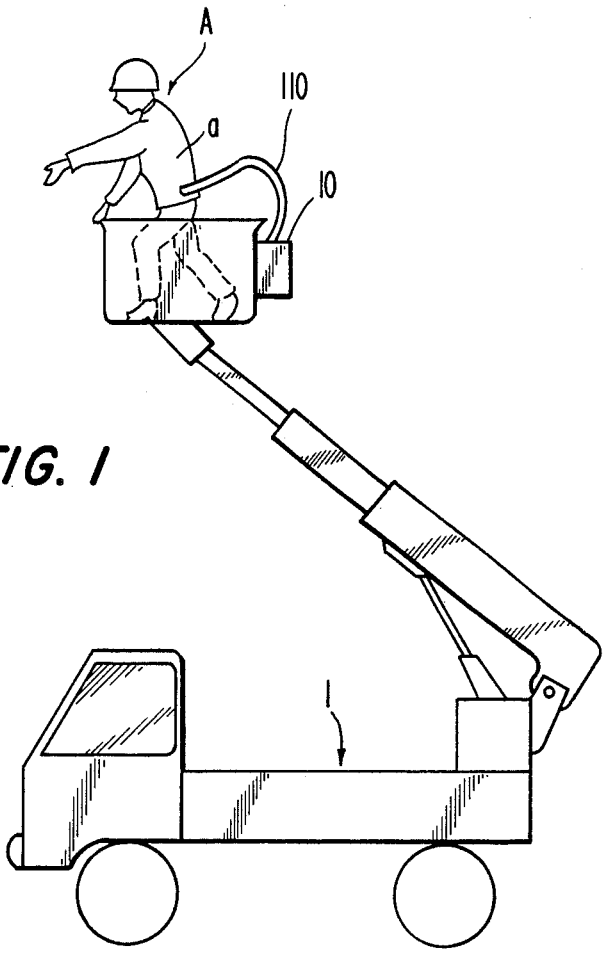
FIG. 1 is a schematic side view showing a working vehicle adapted for work on overhead power lines.
Figure 2:
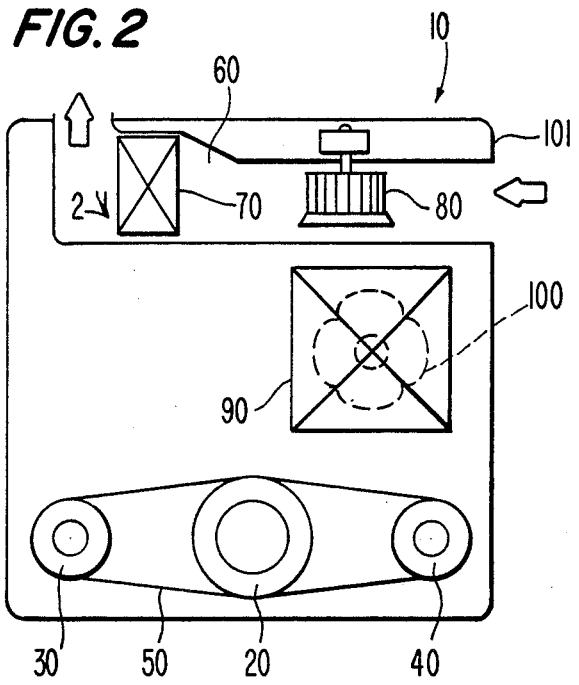
FIG. 2 is a schematic view of a conventional air conditioning system for use in a working vehicle adapted for work on overhead power lines.
Figure 3:
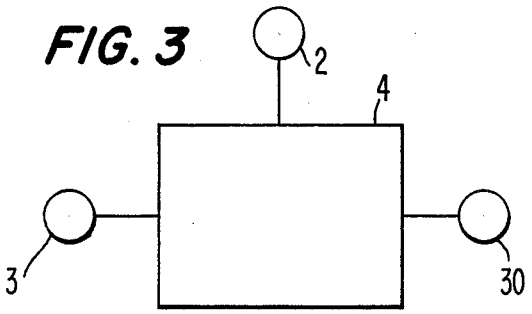
FIG. 3 is a schematic diagram of a drive circuit for an air conditioning system as shown in FIG. 2.
Figure 4:
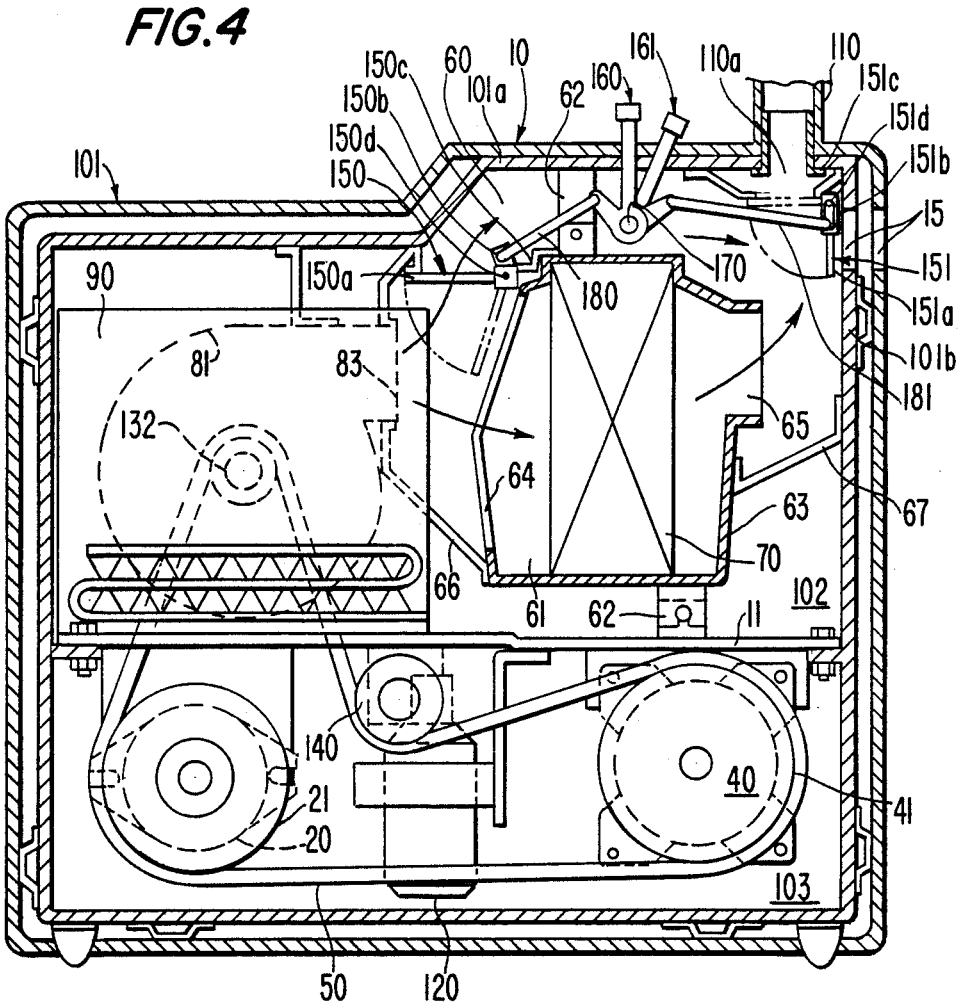
FIG. 4 is a vertical cross-sectional view of an air conditioning system in accordance with one embodiment of this invention.
Figure 5:
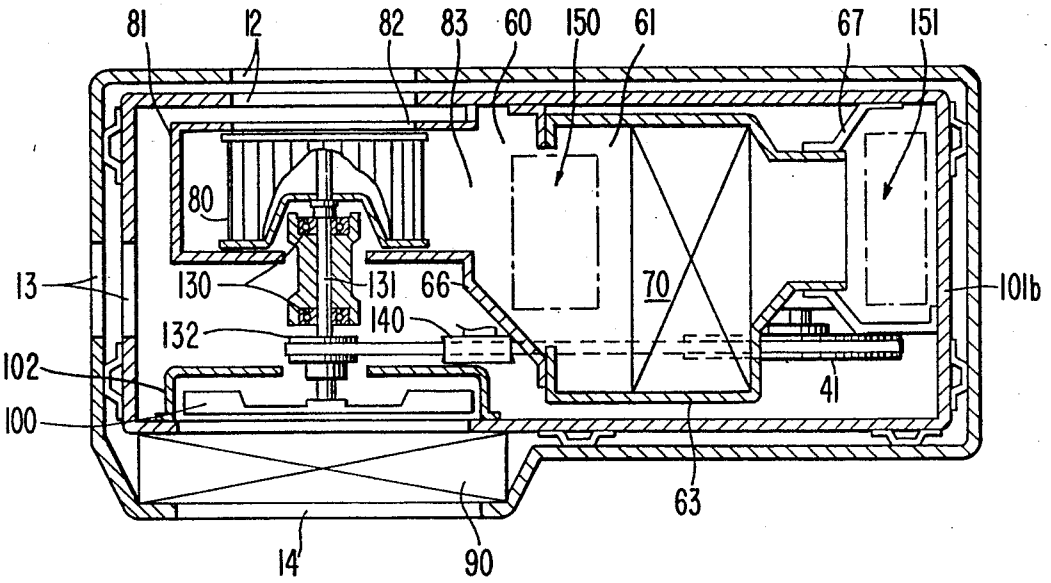
FIG. 5 is a horizontal cross-sectional view of the air conditioning system shown in FIG. 4.
Figure 6:
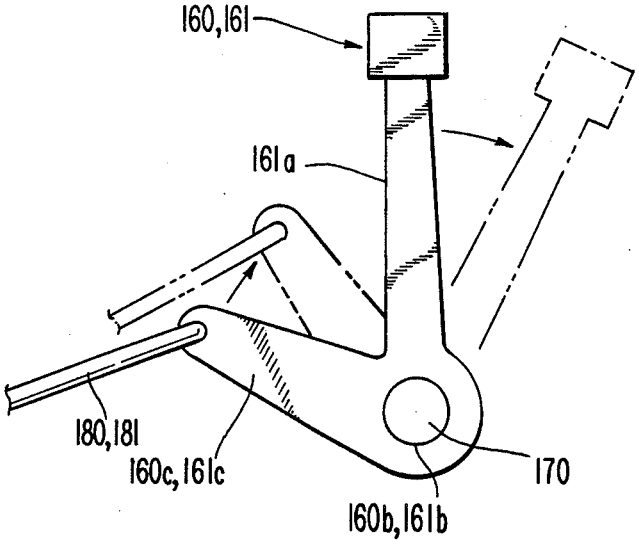
FIG. 6 is a side view of an operating lever as shown in FIG. 4.

FIGS. 4, 5 and 6 show an air conditioning system in accordance with one embodiment of the present invention. The same numerals are used to denote parts which correspond to those in the above-described air conditioning system. Air conditioning system 10 comprises a case 101 which includes a partition plate 11. Partition plate 11 divides the interior of case 101 into an upper housing 102 and a lower housing 103. An oil hydraulic motor 20, a compressor 40 and a receiver dryer 120 are mounted on the lower end surface of partition plate 11 in lower housing 103. An upper passageway 60, a lower passageway 61, an evaporator 70, fans 80 and 100, and a condenser 90 are disposed in upper housing 102. Compressor 40, condenser 90, receiver dryer 120, an expansion valve (not shown) and evaporator 70 are connected series and comprise a refrigerant circuit.

Fan 80 for evaporator 70 is arranged in relation to fan 100 for condenser 90 as shown in FIG. 5. Fans 80 and 100 are coupled by a common drive shaft 131 and are covered by fan casing 81 and fan shroud 102, respectively. Drive shaft 131 includes a small diameter pulley 132 and is supported by case 101 through a bearing 130. Large diameter pulleys 21 and 41 are mounted on the drive shafts of motor 20 and compressor 40, respectively. Pulleys 21, 41 and 132 are coupled together by belt 50 through an idle pulley 140. Thus, rotational force is transmitted to compressor 40 and fans 80 and 100 by the rotation of oil hydraulic motor 20. Lower passageway 61 is disposed below upper passageway 60 and includes a cylindrical member 63 which is attached to an inner surface of upper plate 101*a* and an upper end surface of partition plate 11 through a plurality of metal fittings 62. Evaporator 70 is disposed within lower passageway 60. Inlet port 64 is formed on one end of cylindrical member 63 and faces the outlet port 83 of fan casing 81. Outlet port 65 is formed on the other end of cylindrical member 63 and faces side plate 101*b* of case 101. Cover plate 66 is disposed on the outer surface of outlet port 83 such that its upper end portion is connected to the inner surface of upper plate 101*a* of case 101 and its lower end portion is connected to the lower end portion of inlet port 64. Cover plate 67 connects outlet port 65 of cylindrical member 63 with the inner surface of side plate 101*b*. The positioning cover plates 66 and 67 as described above prevents air circulated by fan 80 from leaking into portions of case 101 other than upper and lower passageways 60 and 61.

Air mix damper mechanism 150 is disposed in the upper portion of cylindrical member 63. Damper mechanism 150 includes damper plate 150*a*, connecting part 150*b*, metal fitting 150*c* and pin 150*d*. One end of metal fitting 150*c* is fixedly secured to the upper end surface of cylindrical member 63 and its other end includes a hole. One end of connecting part 150*b* is attached to one end of damper plate 150*a* and the other end of the connecting part includes a hole. Pin 150*d* is inserted into the hole of metal fitting 150*c* and damper plate 150*a* is thereby rotatably supported by pin 150*d*.

The air flow which exits from outlet port 83 of fan casing 81 is divided by air mix damper 150 into two separate flows. One portion of the air flow from outlet port 83 is directed into upper passageway 60 and the other portion is directed into lower passageway 61. The air flow volume which is directed into each of the passageways 60 and 61 is controlled by changing the angle of damper plate 150*a*. The air which passes through the lower passageway 61 is cooled by evaporator 70 and the air which passes through upper passageway 60 is not cooled. The air which passes through passageways 60 and 61 is subsequently mixed together. Accordingly, the control of the volume of air which is directed in the respective passageways permits control of the temperature of the air which flows from outlet port 110*a* to flexible hose 110.

Control damper mechanism 151 is disposed on side plate 101*b*. Control damper mechanism 151 includes open and close damper plate 151*a*, connecting part 151*b* and metal fitting 151*c*. One end of metal fitting 151*c* is fixedly secured to the inner end surface of side plate 101*b* and the other end of fitting 151*c* includes projection 151*d*. Connecting part 151*b* is attached to one end of the damper plate 151*a* and includes holes at both its sides. Projection 151*d* of metal fitting 151*c* is inserted into one hole of connection part 151*b*, and thus damper plate 151*a* is rotatably supported at projection 151*d*.

The air flow from outlet port 65 of cylindrical member 63 is divided by damper plate 151*a* into two separate flows. One portion of the air flow from outlet port 65 is directed through outlet port 110*a* to flexible hose 110 and the other portion is directed through outlet port 15 which is formed in side plate 101*b*. The portion of the air flow which is directed to either outlet port 110*a* or 15 is determined by controlling the angle of damper plate 151*a*.

Operating levers 160 and 161 are secured to the end surface of upper plate 101*a* and movably supported by supporting member 170. Operating levers 160 and 161 respectively include first operating bars 160*a* and 161*a*, second operating bars 160*c* and 161*c*, and holes 160*b* and 161*b* to insert supporting member 170 therein. The first and second operating bars of operating levers 160 and 161 integrally formed in a V-shape. One end of connecting rod 180 is rotatably connected to connecting part 150*b* and the other end of connecting rod 180 is rotatably connected second operating bar 160*c*. Likewise, one end of connecting rod 181 is rotatably connected to connecting part 151*b* and the other end of connecting rod 181 is rotatably connected to one end of second operating bar 161*c*. Due to the above connections, air mix damper mechanism 150 and control damper mechanism 151 operate to change the angle of damper plates 150*a* and 151*a* in accordance with the operation of operating levers 160 and 161.

In the above-described embodiment, when oil hydraulic motor 20 is started, pulley 21 begins to rotate, and rotational force is transmitted to pulleys 41 and 132 through belt 150. Compressor 40 is driven by pulley 41, and refrigerant flows from compressor 40 and circulates through condenser 90, receiver dryer 120, an expansion valve (not shown) and evaporator 70. Fans 80 and 100 are driven together with drive shaft 131 by pulley 132. The atmosphere taken in by fan 80 passes through first inlet port 12 formed in case 101 and inlet port 82 of fan casing 81 and subsequently flows in either upper passageway 60 or lower passageway 61. The atmosphere taken in by fan 100 passes through second inlet port 13 formed in case 101 and condenser 90 and subsequently flows out through outlet port 14.

During operation of compressor 40, if air mix damper 150 is rotated clockwise by moving first operating lever 160 toward the right side in FIG. 4, the air flow volume into lower passageway 61 increases. Thus decreases the temperature of the air flow which flows from outlet part 110*a* into hose 110. On the other hand, if air mix operating lever 160 is moved in the opposite direction, the air flow volume into lower passageway 61 is decreased. Thus, the air flowing into hose 110 is not cooled as much. In this manner, the temperature of the air flow may be controlled.

In addition, the air flow volume into suit a may be controlled by the positioning of damper plate 151*a* through the use of operating lever 161. If damper plate 151*a* is rotated counterclockwise by moving lever 161 toward the right in FIG. 4, the air flow volume from outlet port 110*a* into hose 110 is increased since less air is directed through port 15. This increases the flow of air into suit a. If damper plate 151*a* is rotated clockwise by moving lever 161 toward the left in FIG. 4, the air flow volume from outlet port 110*a* into hose 110 is decreased. This decreases the flow of air into suit a.

In the above construction, compressor 40, fans 80 and 100, and damper mechanisms 150 and 151 are not driven by electric energy. Therefore, this air conditioning unit may be used safely by those who work in close proximity to power lines and other sources of electricity. In addition, since the motors are not needed for fans 80 and 100, the cost of operating the air conditioning system may be reduced.

It should be noted that although the invention has been described for use by a worker working in proximity to a source of electricity, the invention is not limited in this respect. As noted, such a system may be employed where it is desired to reduce the costs associated with an air conditioning system. Thus, the teachings of this invention may be used for a wide variety of applications.

Figure 7:
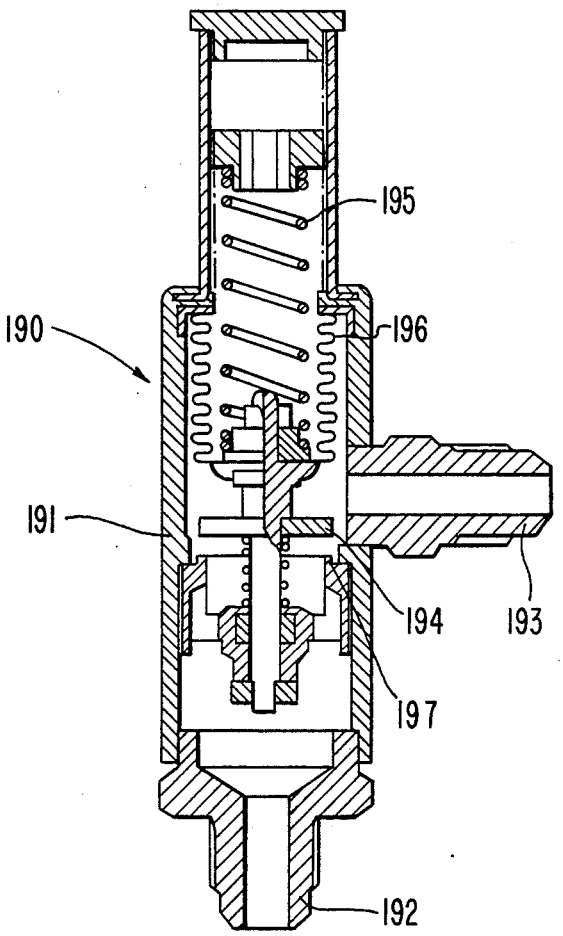
FIG. 7 is a enlarged cross-sectional view of a pressure control device in accordance with another embodiment of this invention.

FIG. 7 illustrates a pressure control device according to another embodiment of the present invention. Pressure control device 190 comprises a casing 191 which includes an inlet port 192 at one end and outlet port 193 disposed on a side portion thereof. A valve 194 and a bellows 196 are disposed within casing 191. Valve 194 is reciprocably disposed within the interior of casing 191. Coil spring 195 is coupled to valve 194. Valve 194 can open and close a valve seat 197 which is formed on the inner surface of casing 191 at the lower portion of outlet port 193. Bellows 196 is disposed in the interior of casing 191 and surrounds coil spring 195. One end of bellows 196 is secured to an inner end surface of casing 191 and the other end is connected to valve 194.

Figure 8:
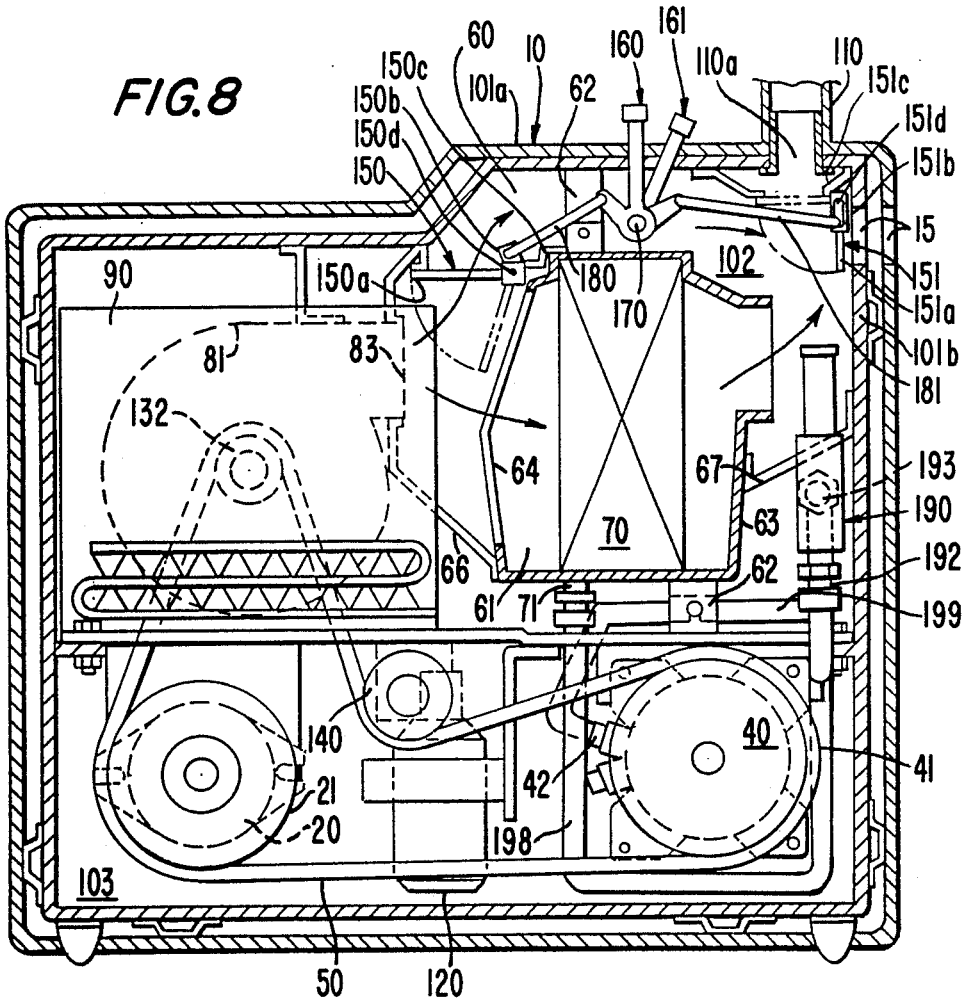
FIG. 8 is a vertical cross-sectional view of an air conditioning system which includes the pressure control device shown in FIG. 7.
Figure 9:
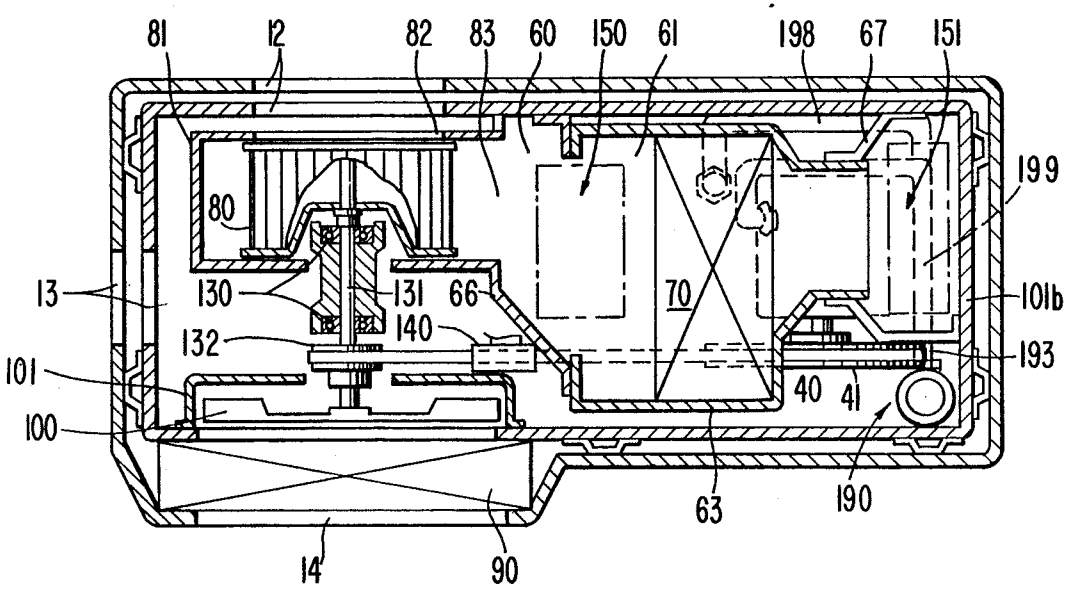
FIG. 9 is a horizontal cross-sectional view of an air conditioning system as shown in FIG. 8.

FIGS. 8 and 9 illustrate the construction of an air conditioning system which includes a pressure control device. Inlet port 192 of pressure control device 190 is coupled through conduit 198 with outlet port 71 of evaporator 70 which extends downwardly through cylindrical member 63. Outlet port 193 of pressure control device 190 is coupled with inlet port 42 of compressor 40 through conduit 199.

In pressure control device 190, when the evaporating pressure of refrigerant in evaporator 70 decreases below a predetermined operating pressure of bellows 196, bellows 196 expands downwardly against the recoil strength of coil spring 195. This forces valve 194 to close valve seat 197, and communication between compressor 40 and evaporator 70 is prevented. This prevents the evaporating pressure of the refrigerant in evaporator 70 from decreasing further. On the other hand, if the evaporating pressure of the refrigerant in evaporator 70 increases beyond a predetermined operating pressure of bellows 196, bellows 196 contracts and valve 194 opens valve seat 197. Evaporator 70 thus communicates with compressor 10, and the evaporating pressure in evaporator 70 may be maintained at a predetermined pressure. The predetermined pressure can be varied by adjusting the recoil strength of coil spring 195.

This invention has been described in detail in connection with preferred embodiments, but these are examples only and this invention is not restricted thereto. It will be easily understood by those skilled in the art that other variations and modifications can be easily made within the scope of this invention.

I claim:

1. In an air conditioning system mounted on an electrically isolated platform including a compressor, a condenser, an evaporator, a first fan for the condenser, a second fan for the evaporator, and an oil hydraulic motor for driving the compressor, an improvement comprising:

belt means coupling said first and second fans with said oil hydraulic motor for transmitting rotational force from said oil hydraulic motor to said first and second fans;

temperature control means for controlling the temperature of air output from the air conditioning system, said temperature control means including first damper means disposed between said second fan and said evaporator for selectively regulating the volume of air which passes through said evaporator; and output control means for controlling the volume of air output from the air conditioning system, said output control means including second damper means disposed adjacent to an output port of said air conditioning system for selectively regulating the volume of air which passes through said output port.

2. The improved air conditioning system according to claim 1 wherein said temperature control means is manually operated.

3. The improved air conditioning system according to claim 1 wherein said output control means is manually operated.

4. The improved air conditioning system according to claim 1 further comprising:

a pressure control means disposed between an outlet port of the evaporator and an inlet port of the compressor for controlling the evaporating pressure of refrigerant in the evaporator to be greater than or equal to a predetermined pressure.

5. The improved air conditioning system according to claim 4 wherein said pressure control means includes a casing having an inlet port and an outlet port, a coil spring disposed within the interior of said casing, a pressure-responsive bellows secured to an inner surface of said casing and surrounding the coil spring, and a valve coupled to said bellows for selectively opening and closing a valve seat formed on the inner surface of said casing.

6. The improved air conditioning system according to claim 1 wherein said rotation transmitting means comprises a belt.

7. An air conditioning system mounted on an electrically isolated platform comprising:

a compressor;

a condenser;

an evaporator;

a first fan for the condenser;

a second fan for the evaporator;

an oil hydraulic motor for driving the compressor, whereby said oil hydraulic motor is operated without electrical power, said oil hydraulic motor coupled to a corresponding oil hydraulic pump through oil hydraulic conduit, said oil hydraulic pump disposed outside of said air conditioning system;

belt means coupling said first and second fans with said oil hydraulic motor for transmitting rotational force from said oil hydraulic motor to said first and second fans;

temperature control means for controlling the temperature of air output from the air conditioning system, said temperature control means including first damper means disposed between said second fan and said evaporator for selectively regulating the volume of air which passes through said evaporator;

output control means for controlling the volume of air output from the air conditioning system, said output control means including second damper means disposed adjacent to an output port of said air conditioning system for selectively regulating the volume of air which passes through said output port; and pressure control means disposed between an outlet port of the evaporator and an inlet port of the compressor for controlling the evaporating pressure of refrigerant in the evaporator to be greater than or equal to a predetermined pressure.

8. The air conditioning system according to claim 7 wherein said pressure control means comprises a casing having an inlet port and an outlet port, a coil spring disposed within the interior of said casing, a pressure-responsive bellows secured to an inner surface of the casing and surrounding the coil spring, and a valve coupled to the bellows for selectively opening and closing a valve seat formed on the inner surface of the casing.

* * * * *

UNITED STATES PATENT AND TRADEMARK OFFICE

CERTIFICATE OF CORRECTION

PATENT NO. : 4,951,477

DATED : August 28, 1990

INVENTOR(S) : Shigenao Tomimatsu

It is certified that error appears in the above-identified patent and that said Letters Patent is hereby corrected as shown below:

Face of Patent, Section [63], delete "Jul. 19, 1988" and insert --Jul. 15, 1988--.

Signed and Sealed this

Tenth Day of December, 1991

*Attest:*

HARRY F. MANBECK, JR.

*Attesting Officer*

*Commissioner of Patents and Trademarks*